US009931865B2

(12) United States Patent
Shimizu

(10) Patent No.: US 9,931,865 B2
(45) Date of Patent: Apr. 3, 2018

(54) HOLDING APPARATUS AND DRAWING APPARATUS

(71) Applicant: CASIO COMPUTER CO., LTD., Shibuya-ku, Tokyo (JP)

(72) Inventor: Daisuke Shimizu, Akishima (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/495,394

(22) Filed: Apr. 24, 2017

(65) Prior Publication Data

US 2018/0001661 A1 Jan. 4, 2018

(30) Foreign Application Priority Data

Jun. 30, 2016 (JP) ..... 2016-129587

(51) Int. Cl.

| | |
|---|---|
| ***A45D 29/00*** | (2006.01) |
| ***B41J 3/407*** | (2006.01) |
| ***A45D 29/22*** | (2006.01) |
| ***B41J 29/06*** | (2006.01) |

(52) U.S. Cl.

CPC ..... *B41J 3/4073* (2013.01); *B41J 29/06* (2013.01); *A45D 29/00* (2013.01); *A45D 29/22* (2013.01)

(58) Field of Classification Search

CPC ..... B41J 3/407; B41J 3/4073; A45D 29/00; A45D 2029/005; A45D 29/22

See application file for complete search history.

(56) References Cited

U.S. PATENT DOCUMENTS

| | | | | |
|---|---|---|---|---|
| 6,286,517 | B1 | 9/2001 | Weber et al. | |
| 8,721,068 | B2 * | 5/2014 | Yamasaki | A45D 29/00 347/104 |
| 2012/0147113 | A1 * | 6/2012 | Yamasaki | A45D 29/00 347/104 |
| 2016/0367010 | A1 * | 12/2016 | Hori | A45D 29/22 |
| 2016/0374450 | A1 * | 12/2016 | Bitoh | A45D 29/22 132/200 |
| 2017/0008305 | A1 * | 1/2017 | Kobayashi | B41J 3/4073 |

FOREIGN PATENT DOCUMENTS

| | | | | |
|---|---|---|---|---|
| JP | 2003534083 | A | 11/2003 | |
| JP | 2016150092 | * | 8/2016 | A45D 29/00 |

* cited by examiner

*Primary Examiner* — Huan Tran
(74) *Attorney, Agent, or Firm* — Holtz, Holtz & Volek PC

(57) ABSTRACT

A holding apparatus includes an insertion space into which an object, namely a finger or a toe including a nail, is inserted; and a plurality of pressing members disposed in the insertion space along an insertion direction of the object into the insertion space, that hold the object inserted into the insertion space in the insertion space. In such a holding apparatus, the insertion space includes an object holding wall provided at a position capable of contacting the object inserted into the insertion space; each of the plurality of pressing members is capable of movement in a first direction pressing the object to a side of the holding wall and a second direction opposite the first direction, and is biased toward the first direction; and a biasing force biasing the a first pressing member of the plurality of pressing members disposed relatively at a back side in the insertion direction is greater than biasing forces biasing the other pressing members.

16 Claims, 8 Drawing Sheets

HOLDING APPARATUS AND DRAWING APPARATUS

CROSS-REFERENCE TO RELATED APPLICATIONS

The present invention contains subject matter related to Japanese Patent No. 2016-129587 filed in the Japanese Patent Office on Jun. 30, 2016, the entire contents of which are incorporated herein by reference.

BACKGROUND OF THE INVENTION

1. Field of the Invention

The present invention relates to a holding apparatus and a drawing apparatus including the same.

2. Description of the Related Art

Conventionally, drawing apparatuses for drawing nail designs on nails are known. An example of such a drawing apparatus is described in Japanese Unexamined Patent Application Publication (Translation of PCT Application) No. 2003-534083.

However, the hand is in an unstable state in cases where a finger, of a nail on which a drawing is to be applied, is simply placed on a mounting stand. As such, the finger may move during the drawing, resulting in deviation of the drawing position, and the finish of the nail printing may not be beautiful.

Thus, conventionally, in the field of drawing apparatuses for drawing nail designs on nails, drawing apparatuses are known that have a structure in which the finger of the nail on which the drawing is to be applied is secured by a holder or similar finger holding part so that the finger of the nail on which the drawing is to be applied does not move during the drawing.

However, human fingers have sizes and thicknesses that vary depending on the type of the finger, from thumbs to little fingers. Furthermore, size, thickness, and the like varies from person to person, even for the same type of finger.

As such, in cases where attempting to apply drawings on a plurality of fingers using a single apparatus, or in cases where a plurality of users attempt to apply drawings using a single apparatus, the various fingers will be secured using a single finger holding part. As a result, for example, thick fingers such as thumbs may be squeezed too tightly and cause the user pain or, conversely, thin fingers such as little fingers may not be sufficiently secured and positional deviation may occur during the drawing.

Furthermore, as fingers have various shapes, it has been difficult to align a height position of a top surface of the nail, for all types of fingers, so as to be substantially horizontal and at a predetermined height.

For example, even if the height of the tip area of the nail is aligned with a predetermined height position, the entire nail may slant downward such that root side drops in cases where the height of the base side of the finger is comparatively low (the thickness of the finger is thin).

BRIEF SUMMARY OF THE INVENTION

According to the present invention, a holding apparatus whereby a variety of fingers can be secured such that a height position of a top surface of each finger is constant; and a drawing apparatus including the same can be provided.

A holding apparatus of the present invention that achieves the advantageous effects described above includes an insertion space into which an object, namely a finger or a toe including a nail, is inserted; and a plurality of pressing members disposed in the insertion space along an insertion direction of the object into the insertion space, that hold the object inserted into the insertion space in the insertion space. In such a holding apparatus, the insertion space includes an object holding wall provided at a position capable of contacting the object inserted into the insertion space; each of the plurality of pressing members is capable of movement in a first direction pressing the object to a side of the holding wall and a second direction opposite the first direction, and is biased toward the first direction; and a biasing force biasing the a first pressing member of the plurality of pressing members disposed relatively at a back side in the insertion direction is greater than biasing forces biasing the other pressing members.

A drawing apparatus of the present invention that achieves the advantageous effects described above includes a holding apparatus that holds an object, namely a finger or a toe including a drawing object, namely a nail; and a drawing device that performs a drawing on the nail of the object held by the holding apparatus. Additionally, the holding apparatus includes an insertion space into which the object is inserted; and a plurality of pressing members disposed in the insertion space along an insertion direction of the object into the insertion space, that hold the object inserted into the insertion space in the insertion space. In this holding apparatus, the insertion space includes an object holding wall provided at a position capable of contacting the object inserted into the insertion space; each of the plurality of pressing members is capable of movement in a first direction pressing the object to a side of the holding wall and a second direction opposite the first direction, and is biased toward the first direction; and a biasing force biasing the a first pressing member of the plurality of pressing members disposed relatively at a back side in the insertion direction is greater than biasing forces biasing the other pressing members.

DETAILED DESCRIPTION OF THE INVENTION

Figure 1B:
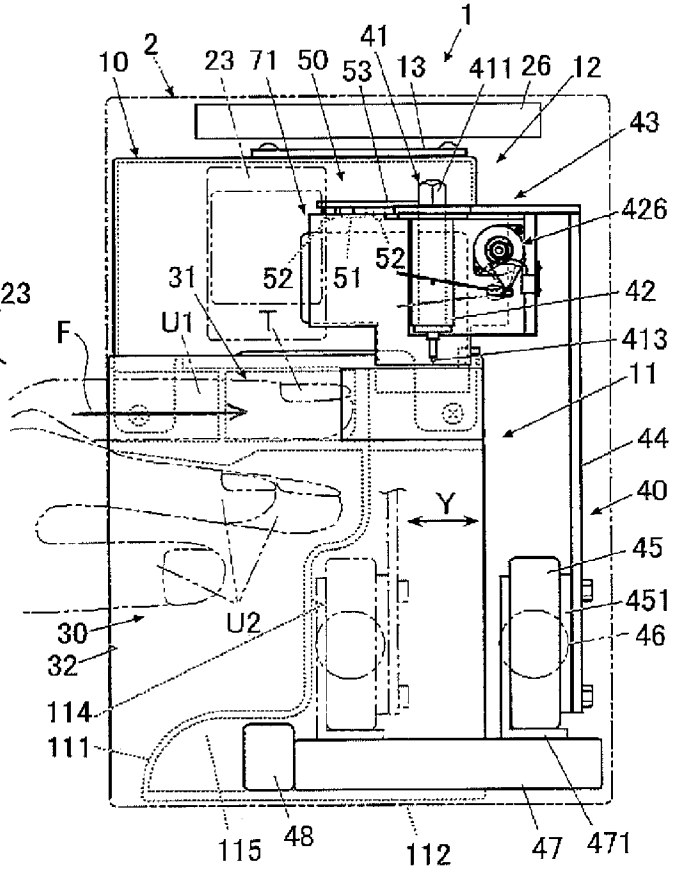
FIG. 1B is a side view illustrating an internal configuration of the drawing apparatus illustrated in FIG. 1A.

An embodiment of a finger holding apparatus and a nail printing apparatus (drawing apparatus) according to the present invention is described below in detail while referring to the drawings.

While various limitations, which are technically preferable from the perspective of carrying out the present invention, are placed on the embodiment described below, the scope of the present invention should not be construed to be limited to the embodiment or the examples illustrated in the drawings.

In the following embodiment, a nail printing apparatus 1 will be described as an apparatus for drawing on a drawing object, namely a fingernail, in which a finger is the object. However, the drawing object surface of the present invention is not limited to fingernails, and for example, the drawing object may be a toenail.

Figure 1A:
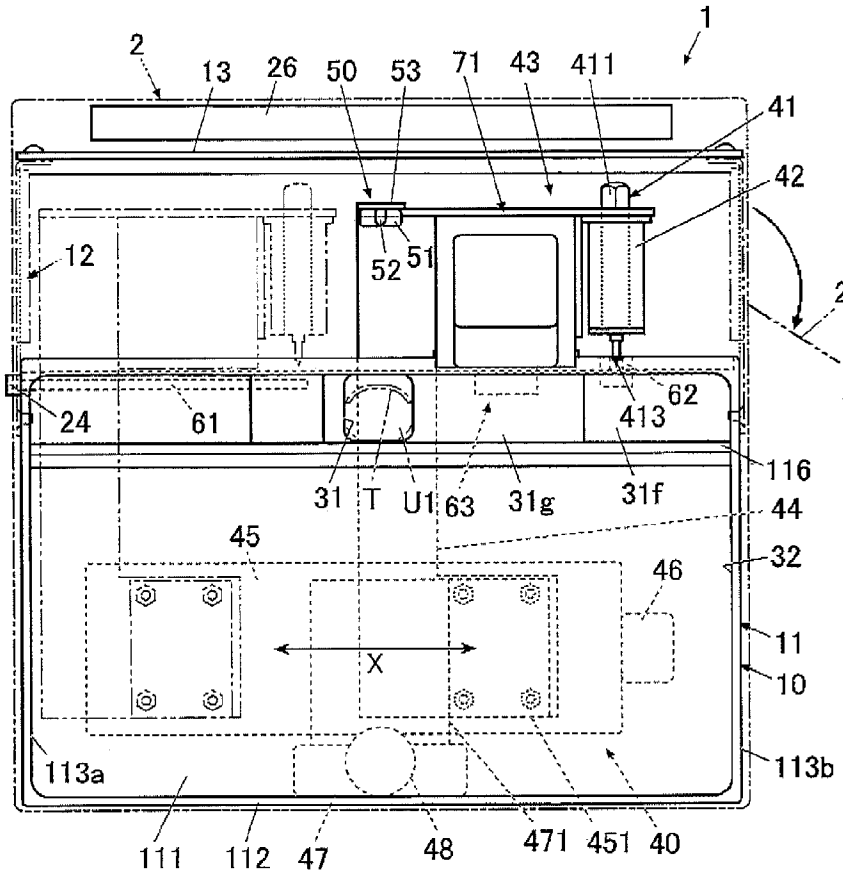
FIG. 1A is a front view of a drawing apparatus according to an embodiment of the present invention.

FIG. 1A is a front view of a nail printing apparatus illustrating an internal configuration of the nail printing apparatus.

FIG. 1B is a side view illustrating the internal configuration of the drawing apparatus illustrated in FIG. 1A.

As illustrated in FIGS. 1A and 1B, in the nail printing apparatus 1 of the present embodiment, a drawing head 43 is provided with drawing tools, namely a pen 41, and an ink jet drawing head 71. The nail printing apparatus 1 of the present embodiment uses plotter printing and ink jet printing to apply a drawing on a nail T of a print finger U1.

The nail printing apparatus 1 is provided with a case body 2 and an apparatus main body 10 housed in the case body 2. As illustrated in FIG. 1B, the print finger U1 is inserted into the nail printing apparatus 1 along a finger inserting direction F.

A cover 23, configured to be openable and closeable, for replacing the pen 41 and the ink jet drawing head 71 of the hereinafter described drawing device 40 is provided in an edge of an upper area of a side surface of the case body 2.

The cover 23 is rotatable via, for example, a hinge or the like, from a closed state to an open state, as illustrated in FIG. 1A.

An operation device 25 (see FIG. 11) is set on an upper surface (top panel) of the case body 2.

The operation device 25 is an input device where a user performs various types of input.

Operation buttons (not illustrated) for performing various types of input are set in the operation device 25. Examples of the operation buttons include a power switch button for turning on the power of the nail printing apparatus 1, a stop switch button for stopping operation, a design selection button for selecting a design image to be drawn on the nail T, a drawing start button for commanding the drawing to start, and the like.

A display device 26 is set approximately in a center area of the top surface (top panel) of the case body 2.

The display device 26 is configured from, for example, a liquid crystal display (LCD), an organic electroluminescence display, or other type of flat display.

In the present embodiment, examples of images appropriately displayed on the display device 26 include nail images obtained by imaging the print finger U1 (finger images including images of the nail T), images of the outline or the like of the nail T included in the nail images, design selection images for selecting a design image to be drawn on the nail T, thumbnail images for design confirmation, command screens displaying various commands, and the like.

Note that a configuration is possible in which a touch panel for performing various types of input is integrated into the surface of the display device 26.

The apparatus main body 10 is formed into a rough box-shape and is provided with a lower frame 11 set in the lower area of the interior of the case body 2, and an upper frame 12 set above the lower frame 11 and in the upper area of the interior of the case body 2.

First, the lower frame 11 will be described.

The lower frame 11 has a back surface plate 111, a bottom plate 112, a pair of left and right side plates 113*a* and 113*b*, an X-direction movement stage housing 114, a Y-direction movement stage housing 115, and a dividing wall 116.

Bottom edges of the side plates 113*a* and 113*b* are joined respectively to left and right edges of the bottom plate 112. The side plates 113*a* and 113*b* are provided in an upright state on the bottom plate 112.

A lower area of the back surface plate 111 is formed so as to sink forward (front side along the finger insertion direction F) in two stages. The bottom edge of the back surface plate 111 is joined to a front edge of the bottom plate 112, and the back surface plate 111 divides the area surrounded by the bottom plate 112 and the side plates 113*a* and 113*b* into front and back.

The space formed on the back side of the sunken back surface plate 111 becomes the X-direction movement stage housing 114 and the Y-direction movement stage housing 115 (see FIG. 1B).

An X-direction movement stage 45 of the drawing device 40 is housed in the X-direction movement stage housing 114 when the drawing device 40 is moved forward (front side along the finger insertion direction F).

A Y-direction movement stage 47 of the drawing device 40 is disposed in the Y-direction movement stage housing 115.

The dividing wall 116 is provided inside the lower frame 11 so as to vertically divide the space on the front side inside the lower frame 11 (the space on the front side along the finger insertion direction F surrounded by the back surface plate 111, the bottom plate 112, and the side plates 113*a* and 113*b*).

The dividing wall 116 is provided roughly horizontally, left and right edges of the dividing wall 116 are joined respectively to the side plates 113*a* and 113*b*, and a back edge of the dividing wall 116 is joined to the back surface plate 111.

A finger holding space 30 (see FIG. 1B) is provided integrally in the lower frame 11.

The finger holding space 30 is configured from a finger insertion space 31 into which the finger is inserted, the finger corresponding to the nail T on which a drawing will be performed (hereinafter referred to as "print finger U1"), and a finger resting space 32 for resting fingers other than the print finger U1 (hereinafter referred to as "non-print fingers U2").

The finger insertion space 31 is disposed on an upper side of the dividing wall 116 and roughly in a center portion in a width direction of the lower frame 11.

The space on the lower side of the lower frame 11, partitioned by the dividing wall 116, forms the finger resting space 32.

For example, in cases where a drawing is performed on the nail T of a ring finger, the ring finger is inserted into the finger insertion space 31 as the print finger U1, and the non-print fingers U2, namely the other four fingers (thumb, index finger, middle finger, and little finger) are inserted into the finger resting space 32.

A front wall 31*f* (see FIG. 1A) that closes the front surface side of the lower frame 11 is provided on the top surface of the dividing wall 116, at both end areas on the front surface side of the lower frame 11.

A pair of guide walls 31*g* (see FIG. 1A) that guides the print finger U1 into the finger insertion space 31 is erected on the top surface of the dividing wall 116, and the pair of guide walls 31*g* narrows from the end of the front wall 31*f* on the center area side toward the finger insertion space 31.

The finger insertion space 31 into which the print finger U1 is inserted is a space surrounded by a plurality of walls (in the present embodiment, side walls and the like of an upper case 34) and, of the plurality of walls forming the finger insertion space 31, one is a finger holding wall, described later (that is, a finger holding wall 346 of the upper case 34).

A finger holding apparatus 33 constituted by a pressing mechanism 330 and the like is provided in the finger insertion space 31.

Here, the configuration of the finger holding apparatus 33 of the present embodiment will be described in detail while referring to FIGS. 2 to 9.

Figure 2:
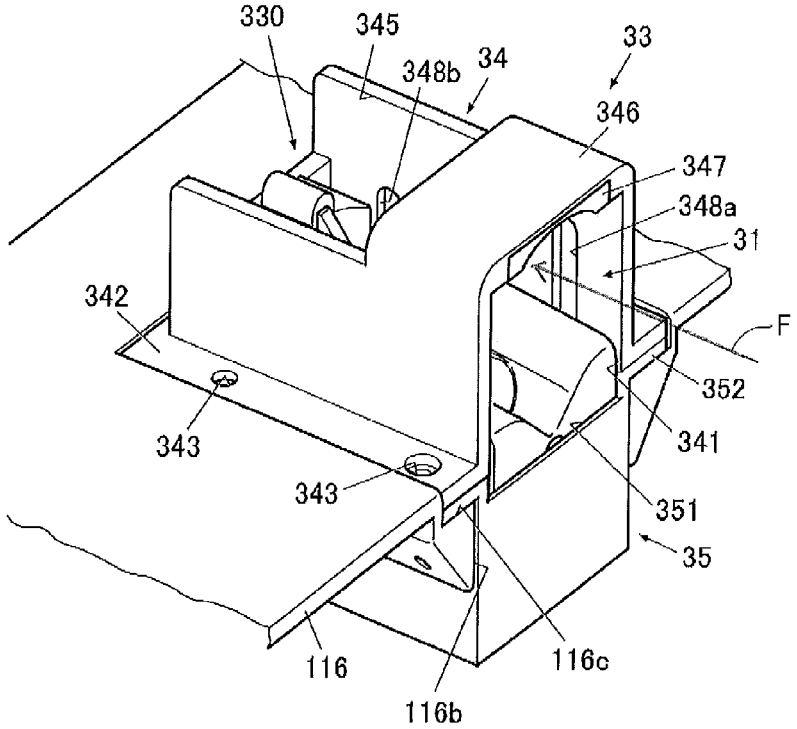
FIG. 2 is a perspective view of a finger holding apparatus of the present embodiment.

FIG. 2 is a perspective view of a finger insertion space in which the finger holding apparatus of the present embodiment is disposed.

Figure 3:
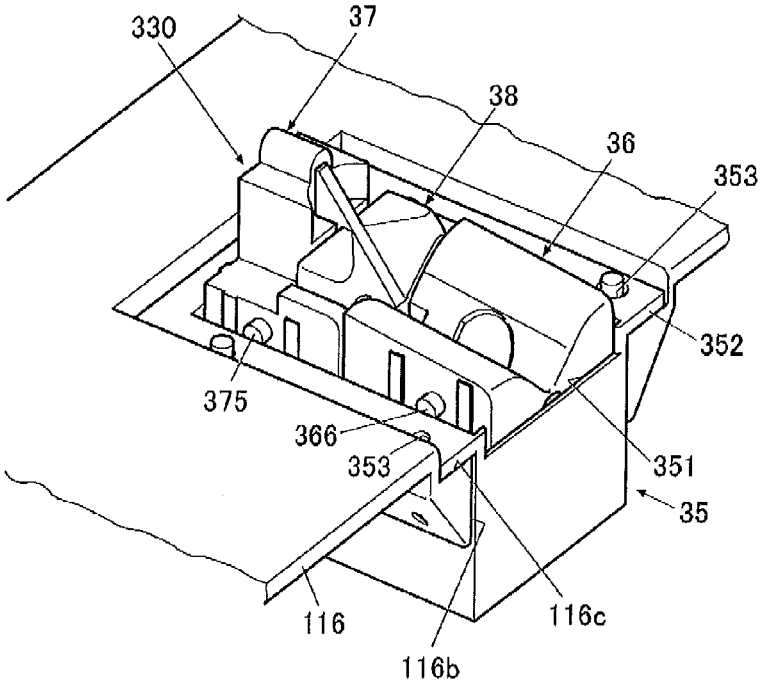
FIG. 3 is a perspective view of the finger holding apparatus, illustrating a state in which an upper case is removed from the finger holding apparatus illustrated in FIG. 2.

FIG. 3 is a perspective view illustrating a state in which the upper case 34 is removed from FIG. 2.

Figure 4:
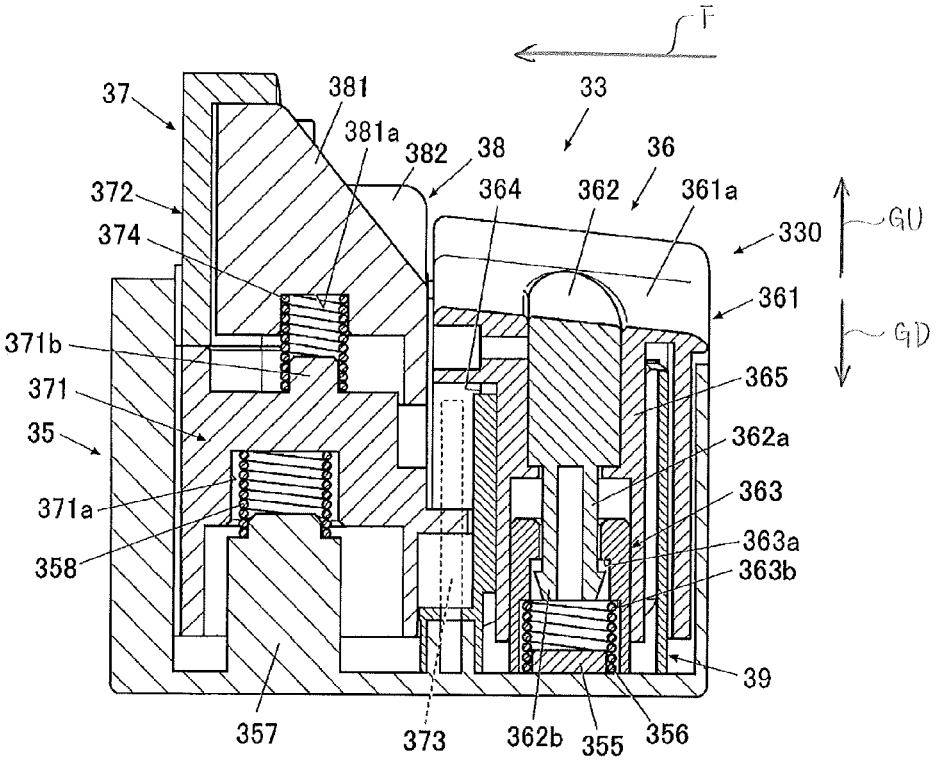
FIG. 4 is a cross-sectional view of the finger holding apparatus of the present embodiment.

FIG. 4 is a side cross-sectional view of the finger holding apparatus of the present embodiment.

As illustrated in FIG. 2, the finger holding apparatus 33 is disposed in the finger insertion space 31 of the present embodiment, and the finger holding apparatus 33 includes the pressing mechanism 330 housed inside the upper case 34 and a lower case 35 that are formed substantially in a box shape.

A lower surface side of the upper case 34 is an aperture 341, and an outward facing flange area 342 is formed along a rim of this aperture 341.

Screw holes 343 are formed in the outward facing flange area 342 at two locations on both sides of the upper case 34.

An upper surface side of the lower case 35 is an aperture 351, and an outward facing flange area 352 is formed along a rim of this aperture 351.

Screw holes 353 are formed in the outward facing flange area 352 at two locations on both sides of the lower case 35.

As illustrated in FIG. 2, a guide groove 348*a* that guides a second pressing member 36, described later, in the vertical direction (the vertical direction GU, GD in FIG. 4) when the second pressing member 36 presses, and a guide groove 348*b* that guides a hereinafter described first pressing member 37 in the vertical direction (the vertical direction GU, GD in FIG. 4) when the first pressing member 37 presses are formed in both side surfaces of the upper case 34.

Figure 5:
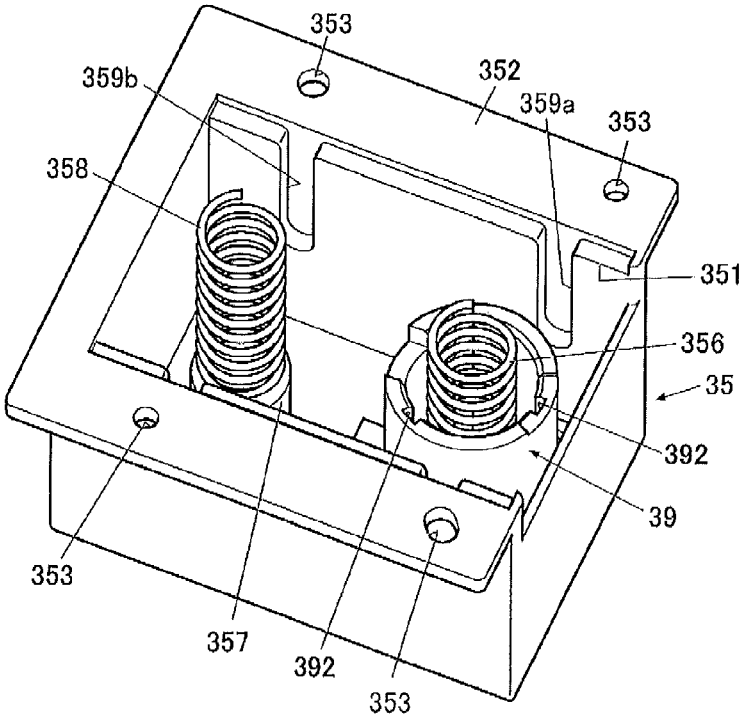
FIG. 5 is a perspective view of a lower case of the present embodiment.

FIG. 5 is a perspective view of the lower case 35.

As illustrated in FIGS. 4 and 5, a second engagement protrusion 355 and a first engagement protrusion 357 are erected on an inner bottom surface of the lower case 35 of the present embodiment.

A base end side of a biasing member, namely a second spring (a second biasing member) 356, biasing the second pressing member 36, described later, in the upward direction GU (a first direction), is engaged with the second engagement protrusion 355.

A base end side of a biasing member, namely a first spring (a first biasing member) 358, biasing the first pressing member 37, described later, upward GU, is engaged with the first engagement protrusion 357.

As illustrated in FIG. 5, a guide groove 359*a* that guides the second pressing member 36, described later, in the vertical direction (the vertical direction GU, GD in FIG. 4) when the second pressing member 36 presses, and a guide groove 359*b* that guides the first pressing member 37, described later, in the vertical direction (the vertical direction GU, GD in FIG. 4) when the first pressing member 37 presses are formed in both side surfaces of the lower case 35.

In the present embodiment, a configuration is given in which the upper case 34 is fitted on the lower case 35 in a state in which the aperture 341 of the upper case 34 is facing down. Furthermore, in this configuration, an engaging area 344 of the upper case 34 engages with the side surface inner side of the lower case 35 and the outward facing flange areas 342 and 352 of the upper case 34 and the lower case 35 overlap when the upper case 34 and the lower case 35 are fitted together.

In the present embodiment, a configuration is given in which a notched portion 116*b* is formed in the dividing wall 116 at a position corresponding to the finger insertion space 31, and area around this notched portion 116*b* is a step portion 116*c* lowered one step from the top surface of the dividing wall 116.

The lower case 35 is configured to fit into the notched portion 116*b* and, in a state in which the upper case 34 is fitted on the lower case 35, the outward facing flange areas 342 and 352 are disposed on the step portion 116*c* of the dividing wall 116, and the top surface of the outward facing flange area 342 of the upper case 34 is substantially flush with the top surface of the dividing wall 116.

In this fitted state, screws (not illustrated in the drawings) are inserted through the screw holes 343 and 353 of the outward facing flange areas 342 and 352 so as to screw the outward facing flange areas 342 and 352 to the dividing wall 116. Thus, the upper case 34 and the lower case 35 are fixed to the dividing wall 116.

As illustrated in FIG. 2, in the state in which the upper case 34 and the lower case 35 are fixed to the dividing wall 116, the front side along the finger insertion direction F of the upper case 34 is open.

The top surface and back side along the finger insertion direction F of the upper case 34 is configured as a window area 345 for exposing the nail T of the print finger U1 inserted in the finger insertion area 31. Moreover, the top surface and front side along the finger insertion direction F of the upper case 34 is configured as the finger holding wall 346 that prevents the height of the print finger U1 from becoming too high.

In the present embodiment, a state in which the nail T is exposed through the window area 345 and the top side of the print finger U1 is at a position (height position) contacting a bottom surface of the finger holding wall 346 is a drawable position at which drawing using the pen 41 and the ink jet drawing head 71 of the drawing device 40 can be suitably performed on the nail T exposed through the window area 345.

A cushioning member 347 formed from resin or the like is provided at the portion of the finger holding wall 346 of the present embodiment where the top side of the print finger U1 contacts (that is, the inside surface of the top surface of the upper case 34).

It is preferable that the cushioning member 347 is provided on the inside surface of the finger holding wall 346 because impact and pain will be felt less when the print finger U1 is pressed up and strikes the finger holding wall 346.

Note that the configuration of the finger holding wall 346 is not limited to the example described herein, and a configuration is possible in which the cushioning member 347 or the like is not provided and the finger holding wall 346 is a simple plate-like member.

As illustrated in FIGS. 2, 3, and 4, the finger holding apparatus 33 of the present embodiment is provided with a pressing mechanism 330 that presses the print finger U1 inserted in the finger insertion space 31.

The pressing mechanism 330 includes a plurality of pressing members disposed along the finger insertion direction F of the print finger U1 so as to be joined to each other and, each of the plurality of pressing members is biased in the upward direction GU by a biasing member.

In the present embodiment, the pressing mechanism 330 includes three pressing members, namely a second pressing member 36 disposed relatively at the front side in the finger insertion direction F, a first pressing member 37 disposed relatively at the back side (in the present embodiment, farthest back) in the finger insertion direction F, and a third pressing member 38 disposed between the second pressing member 36 and the first pressing member 37.

The second pressing member 36 is biased in the upward direction GU by a second biasing member, namely a second spring 356. The first pressing member 37 is biased in the upward direction GU by a first biasing member, namely a first spring 358. The third pressing member 38 is biased in the upward direction GU by a third biasing member, namely a third spring 374.

Here, as illustrated in FIG. 3, the first pressing member 37 has a shape along a third direction orthogonal to the finger insertion direction F of the print finger U1 in the finger insertion space 31, that is, a shape along a width direction of the nail T that curves convexly in an upward direction. As such, as illustrated in the FIGS. 10A and 10B, described later, when the print finger U1 is inserted in the finger insertion space 31, the tip area of the nail T of the print finger U1 is disposed so as to contact a top portion of the first pressing member 37. Thus, the position of the top surface of the nail T of the print finger U1 can be made substantially constant, regardless of the magnitude of the thickness of the print finger U1.

In the present embodiment, biasing force of the first spring 358 biasing the first pressing member 37, disposed relatively at the back side (in the present embodiment, farthest back) along the finger insertion direction F, in the upward direction GU is greater than the other biasing force of the second spring 356 biasing the second pressing member 36 in the upward direction GU and the biasing force of the third spring 374 biasing the third pressing member 38 in the upward direction GU (that is, the biasing force of the first spring 358 is relatively high load).

The biasing force of the third spring 374 biasing the third pressing member 38 in the upward direction GU is less than the biasing force of the second spring 356 and the biasing force of the first spring 358, and is low load.

The biasing force of the second spring 356 biasing the second pressing member 36 in the upward direction GU is less than the biasing force of the first spring 358 and greater than the biasing force of the third spring 374, and is medium load.

Thus, the first spring 358 that biases the first pressing member 37, on which the tip area of the nail is disposed and that is disposed farthest back along the finger insertion direction F, in the upward direction GU is configured as a high load (large biasing force) spring. Therefore, the nail T can reliably be pressed up to the predetermined drawable position (the height position where the nail T is exposed through the window area 345).

Furthermore, the loads (biasing forces) of the biasing members (the second spring 356 and the third spring 374) that bias the other pressing members (the second pressing member 36 and the third pressing member 38) in the upward direction GU are configured to be relatively lower (small biasing forces) than the first spring 358. Therefore, situations where the print finger U1 is pressed excessively hard against the finger holding wall 346 can be prevented.

Particularly, in the present embodiment, the load of the third spring 374 that biases the third pressing member 38, disposed between the second pressing member 36 and the first pressing member 37, in the upward direction GU is configured to be the lowest (small biasing force). Therefore, the third pressing member 38 can be pressed up with a weak force of a magnitude sufficient to fill the gap between the print finger U1 and the third pressing member 38, and the posture of the finger can be held without applying a load to the print finger U1.

Figure 6A:
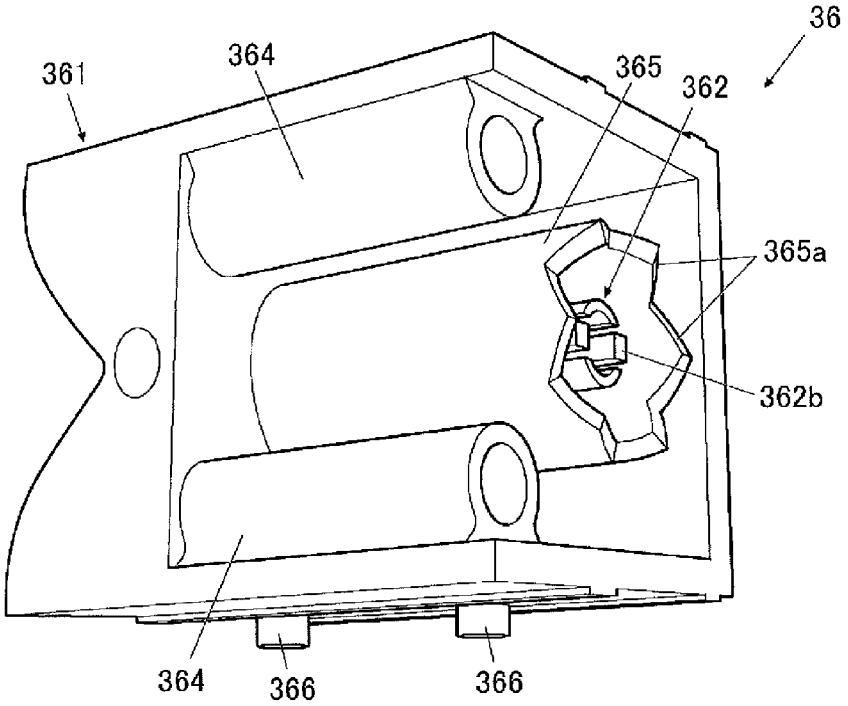
FIG. 6A is a perspective view of a first pressing member of the present embodiment, viewed from diagonally below.
Figure 6B:
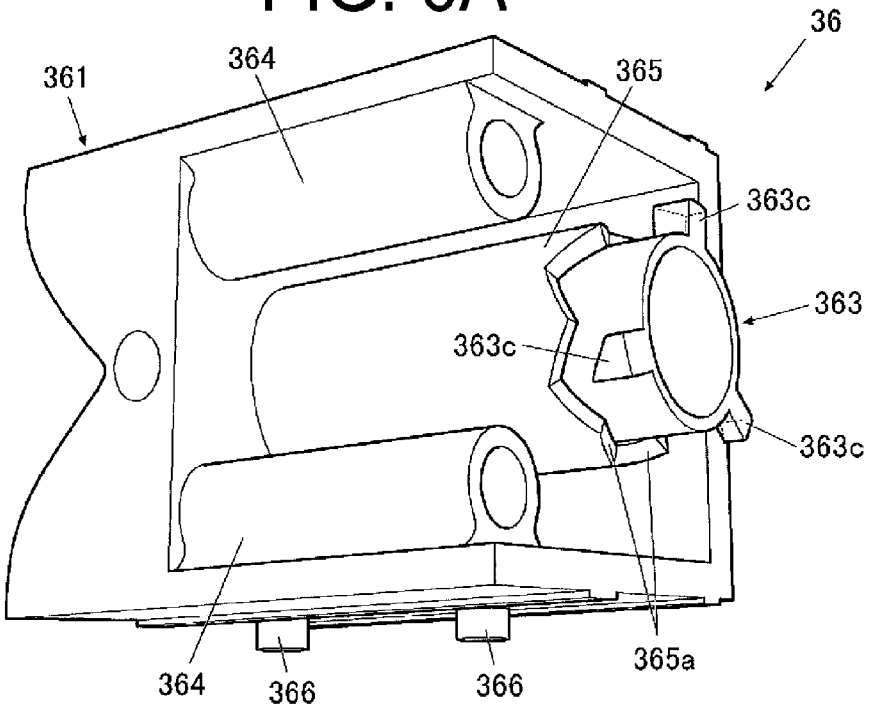
FIG. 6B is a perspective view illustrating a state in which a rotating member is attached to the first pressing member illustrated in FIG. 6A, viewed from diagonally below.

FIGS. 6A and 6B are perspective views of the second pressing member 36, viewed from diagonally below.

As illustrated in FIGS. 4, 6A, and 6B, the second pressing member 36 is provided with a pressing member main body 361 and an engaging shaft portion 362.

A top surface 361*a* of the pressing member main body 361 of the second pressing member 36 is configured as a substantially V-shaped inclined surface that becomes lower from both sides toward a center portion along the finger insertion direction F.

Note that a shape of the top surface 361*a* of the second pressing member 36 may be any shape whereby the print finger U1 can be safely held, and is not limited to the example illustrated in the drawings. For example, the top surface 361*a* may be U-shaped or C-shaped.

As illustrated in FIGS. 6A and 6B, a pair of cylindrical engagement tube portions 364 open at bottom sides thereof is provided at the back side along the finger insertion direction F of the pressing member main body 361.

Engaging shaft portions 373, described later, of the first pressing member 37 are configured to be inserted through the engagement tube portions 364 from the bottom side toward the top side, and the second pressing member 36 and the first pressing member 37 are joined together by inserting the engaging shaft portions 373 into the engagement tube portions 364.

Guide protrusions 366 are provided on side surfaces of the pressing member main body 361 at positions corresponding to the guide grooves 359*a* of the lower case 35 and the guide grooves 348*a* of the upper case 34. The guide protrusions 366 are configured to be guided by the guide grooves 359*a* of the lower case 35 and the guide grooves 348*a* of the upper case 34 so that pressing is performed in a smooth manner when the second pressing member 36 presses.

A hollow and cylindrical knock shaft portion 365 open at the top and bottom is arranged vertically on substantially a central portion of the lower side of the pressing member main body 361 (the lower side in FIG. 4).

As illustrated in FIGS. 6A and 6B, serrated pressing portions 365*a* are provided on a lower side opening edge of the knock shaft portion 365.

The engaging shaft portion 362 is inserted inside the knock shaft portion 365 and is engaged in the knock shaft portion 365 so as not to fall out in the axial direction.

The lower side (the lower side in FIG. 4) of the engaging shaft portion 362 is configured as leg portions 362*a* having springiness, and locking claws 362*b* are provided at tip portions of the leg portions 362*a*.

A cylindrical rotating member 363 open at the top and bottom is engaged at the locking claws 362*b* of the engaging shaft portion 362.

That is, as illustrated in FIG. 4, an inward facing flange 363*a* is formed on the aperture on the upper side (the upper side in FIG. 4) of the rotating member 363, and when the leg portions 362*a* of the engaging shaft portion 362 having springiness are inserted from the aperture on the upper side, the leg portions 362*a* expand inside the rotating member 363 and the locking claws 362*b* abut against the lower side surface of the inward facing flange 363*a* and are engaged.

As such, the engaging shaft portion 362 is engaged with the knock shaft portion 365, is joined to the rotating member 363, and is an engaging member that engages with the knock shaft portion 365 and the rotating member 363.

The knock shaft portion 365 is engaged with the rotating member 363 via the engaging shaft portion 362 and, as such, when the rotating member 363 is fixed to a fixing member 39, described later, the knock shaft portion 365 is not freed but, rather, movement thereof in a height direction (the vertical direction GU, GD in FIG. 4) is restricted.

The rotating member 363 includes engaging protrusions 363*c*, and is pressed on by the pressing portions 365*a* of the knock shaft portion 365, and rotates.

In the present embodiment, the engaging protrusions 363*c* are formed on an edge of the lower side (the lower side in FIG. 4) of the rotating member 363, at substantially equal intervals along an outer periphery of the rotating member 363.

As illustrated in FIG. 6B, the sides of the engaging protrusions 363*c* that contact the pressing portions 365*a* of the knock shaft portion 365 have a shape whereby edge portions thereof are notched diagonally so as to catch on the serrated pressing portions 365*a*.

A step portion 363*b* is formed inside the rotating member 363, and an inner diameter of the rotating member 363 is larger at a side below the step portion 363*b* than at a side above the step portion 363*b*.

In an assembly state in which the first pressing member 37 is disposed in the lower case 35, the second spring (the second biasing member) 356 is disposed inside the rotating member 363 and abuts against the step portion 363*b*. As such, the second pressing member 36, which is engaged with the rotating member 363 via the engaging shaft portion 362 and the rotating member 363, is biased in the upward direction GU by the second spring 356.

A fixing member 39 is disposed at a position on a bottom surface of the lower case 35 that corresponds to the rotating member 363. The fixing member 39 is a member configured to be capable of assuming a locked state in which the engaging protrusions 363*c* of the rotating member 363 are engaged, and an unlocked state in which the engagement is released.

Figure 7A:
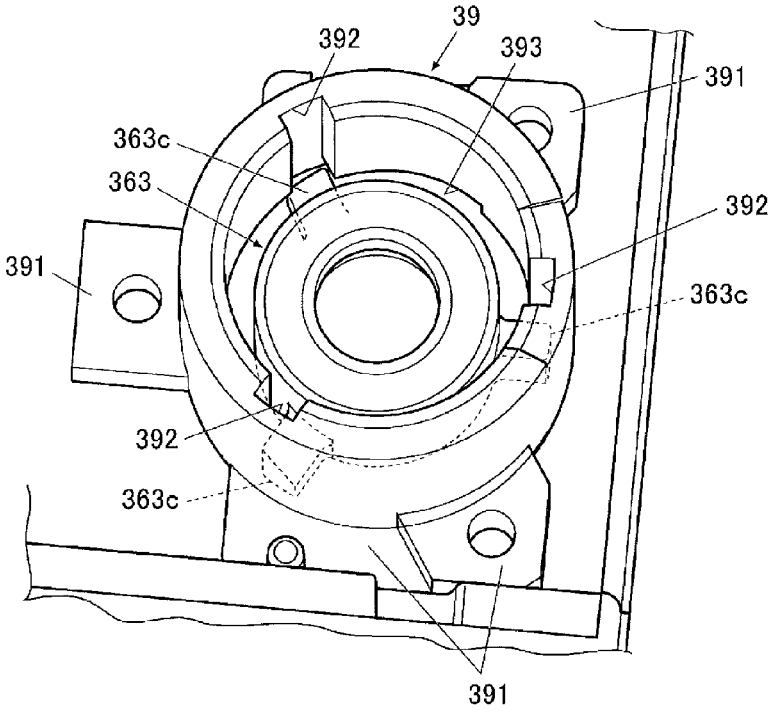
FIG. 7A is a perspective view illustrating a state in which engaging protrusions of the rotating member are fitted in guide grooves of the fixing member of the present embodiment.
Figure 7B:
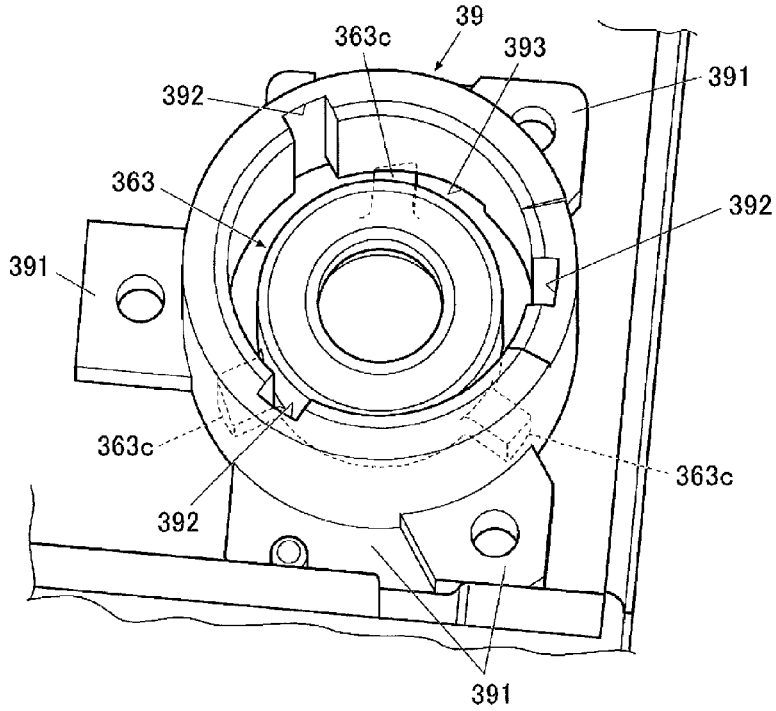
FIG. 7B is a perspective view illustrating a state in which the engaging protrusions of the rotating member are fitted in notched portions of the fixing member illustrated in FIG. 7A.

FIGS. 7A and 7B are perspective views of the fixing member 39.

Note that in FIGS. 7A and 7B, for convenience of illustration, the second pressing member 36 and the engaging shaft portion 362 engaged with the rotating member 363 are not illustrated.

As illustrated in FIGS. 4, 7A, and 7B, the fixing member 39 is a substantially cylindrical, hollow member.

Tongue pieces 391 including a screw hole are formed on a bottom edge of the fixing member 39 (the bottom edge in FIG. 4), and the fixing member 39 is fixed to the bottom surface of the lower case 35 by inserting screws (not illustrated) through the screw holes of the fixing member 39.

The second spring (second biasing member) 356, for which the base end side is engaged to the second engagement protrusion 355, is disposed inside the cylindrical fixing member 39.

Three guide grooves 392 extending in the vertical direction (the vertical direction GU, GD in FIG. 4) are formed along the circumferential direction of the fixing member 39 in the inner circumferential surface of the fixing member 39.

As illustrated in FIG. 7A, the guide grooves 392 are provided at substantially the same spacing as the engaging protrusions 363*c* of the rotating member 363 and have a width that is slightly larger than the width of the engaging protrusions 363*c*. Thus, when the rotating member 363 is pressed in the downward direction GD (the second direction), the engaging protrusions 363*c* can move in the downward direction GD along the guide grooves 392 to the bottom edge of the fixing member 39.

Notched portions 393 constituting engagement grooves that engage with the engaging protrusions 363*c* are formed on the bottom edge of the fixing member 39.

A gap with a height greater than or equal to the thickness of the engaging protrusions 363*c* is formed between the bottom surface of the lower case 35 and the bottom edge of the fixing member 39 at the portion where the notched portions 393 are formed.

As such, as illustrated in FIG. 7B, when the engaging protrusions 363*c* move along the guide grooves 392 to the bottom edge of the fixing member 39 and rotate, the engaging protrusions 363*c* fit into the notched portions 393 and movement of the rotating member 363 in the height direction (the vertical direction GU, GD in FIG. 4) is restricted.

Moreover, in the state in which the rotating member 363 is fixed to the fixing member 39, the first pressing member 37 that is engaged with the rotating member 363 is also fixed to the fixing member 39 via the engaging shaft portion 362 and the rotating member 363, and movement thereof in the height direction (the vertical direction GU, GD in FIG. 4) is restricted.

In the present embodiment, a lock cam mechanism is constituted from the knock shaft portion 365, the rotating member 363, and the fixing member 39 as a locking mechanism whereby movement of a pressing member (in the present embodiment, the second pressing member 36) can be restricted (locked).

Note that the locking mechanism is not limited to the lock cam mechanism described herein, and can be any locking mechanism capable of restricting movement of a pressing member (in the present embodiment, the second pressing member 36). Examples thereof include heart-shaped cam mechanisms and the like.

Figure 8:
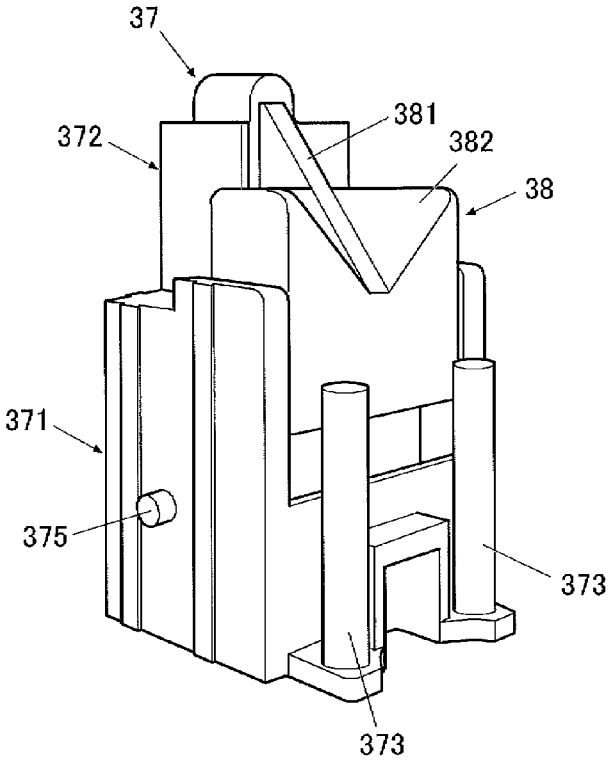
FIG. 8 is a perspective view of a second pressing member of the present embodiment.

FIG. 8 is a perspective view of the first pressing member 37 and the third pressing member 38.

As illustrated in FIGS. 4 and 8, in the present embodiment, the third pressing member 38 is sandwiched in the first pressing member 37 and is integrated with the first pressing member 37.

Specifically, the first pressing member 37 includes a pressing member main body 371 forming a lower side, and a joining portion 372 sandwiching and fixing the third pressing member 38.

Moreover, by connecting the joining portion 372 to the pressing member main body 371 in a state in which the third pressing member 38 is sandwiched, the first pressing member 37 and the third pressing member 38 are integrated.

A recessed portion 371*a* into which the first spring (the first biasing member) 358, of which the base end side is engaged with the first engagement protrusion 357, is fitted is formed in the lower side (the lower side in FIG. 4) of the first pressing member 37. Moreover, in an assembly state in which the first pressing member 37 is disposed in the lower case 35, the first spring (the first biasing member) 358 is disposed in the recessed portion 371*a*. As such, the first pressing member 37 is biased in the upward direction GU by the first spring 358.

As illustrated in FIG. 8, a pair of engaging shaft portions 373 is provided at the front side along the finger insertion direction F of the pressing member main body 371 of the first pressing member 37, at a position corresponding to the engagement tube portions 364 of the second pressing member 36.

As described above, the engaging shaft portions 373 are inserted from the bottom side toward the top side of the engagement tube portions 364 and, as a result, the second pressing member 36 and the first pressing member 37 are joined to each other.

Guide protrusions 375 are provided on side surfaces of the pressing member main body 371 at positions corresponding to the guide grooves 359*b* of the lower case 35 and the guide grooves 348*b* of the upper case 34.

Moreover, the guide protrusions 375 are configured to be guided by the guide grooves 359*b* of the lower case 35 and the guide grooves 348*b* of the upper case 34 so that the pressing is performed in a smooth manner when the first pressing member 37 and the third pressing member 38 that is integrated with the first pressing member 37 press.

As illustrated in FIG. 4, an engagement protrusion 371*b* is provided on a top surface (the surface of the upper side in FIG. 4) of the pressing member main body 371. A base end side of the third spring (the third biasing member) 374 is engaged with this engagement protrusion 371*b*.

As illustrated in FIGS. 4 and 8, the third pressing member 38 includes an inclined portion 381 that is inclined so as to become gradually higher from the front side toward the back side along the finger insertion direction F, and a pressing member main body 382 disposed on both sides of this inclined portion 381.

A top surface of the pressing member main body 382 is inclined so as to become lower from both sides toward the inclined portion 381 in substantially a V-shape and, as a result, restricts movement in the width direction of the print finger U1.

Note that the configuration and shape of the third pressing member 38 are not limited to the example described herein and any configuration and shape whereby movement in the width direction of the print finger U1 is restricted and the print finger U1 can be stably mounted may be used.

A recessed portion 381*a* into which the third spring (the third biasing member) 374, of which the base end side is engaged with the engagement protrusion 371*b*, is fitted is formed in the lower side (the lower side in FIG. 4) of the third pressing member 38. Moreover, in a state in which the third pressing member 38 is integrated with the first pressing member 37, the third spring (the third biasing member) 374 is disposed in the recessed portion 381*a*. As such, the third pressing member 38 is biased in the upward direction GU by the third spring 374.

Figure 9:
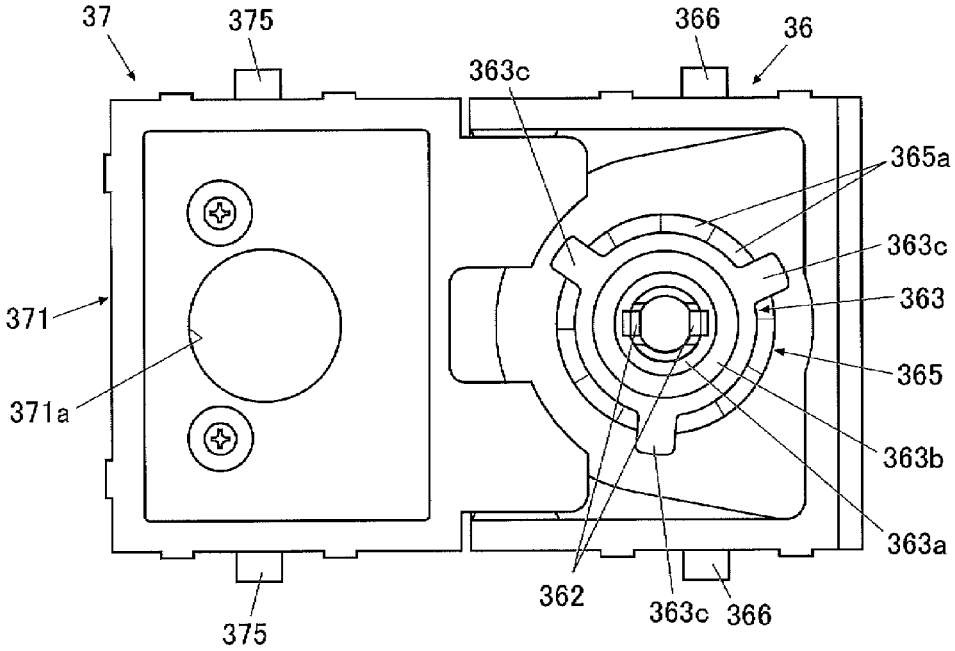
FIG. 9 is a bottom view of a state in which the pressing members of the present embodiment are joined.

FIG. 9 is a drawing illustrating a state in which the second pressing member 36, the first pressing member 37, and the third pressing member 38 that constitute the pressing mechanism 330 are joined to each other, viewed from the back side (the lower side in FIG. 4).

In the present embodiment, the pressing mechanism 330 in this joined state is disposed in the lower case 35, in which, as illustrated in FIG. 5, the fixing member 39, the second spring (the second biasing member) 356, and the first spring (the first biasing member) 358 are disposed. As a result, a finger holding apparatus 33, provided with a pressing mechanism 330 constituted by a plurality of pressing members biased by each of the biasing members, is formed.

A test drawing area 61 is provided on the top surface of the lower frame 11, beside the finger insertion space 31 (location corresponding to a media access port 24 of the case body 2, on the left side in FIGS. 1A and 2). The test drawing area 61 is for performing test drawing to eliminate fading and the like at a time of beginning of drawing by a pen tip (tip portion) 413 of the pen 41 (described hereinafter) within a drawable area of the drawing head 43 (described hereinafter).

The test drawing area 61 is a flat portion and is configured so that drawing media 61*a* inserted through the media access port 24 of the case body 2 is mounted thereon.

The drawing media 61*a* mounted on the test drawing area 61 is not limited, provided that test drawing of the pen tip (tip portion) 413 can be performed, and for example, may be a piece of paper.

A home area where the drawing head 43 stands by at times when the drawing head 43 is not drawing is provided on the top surface of the lower frame 11, across the finger insertion space 31 on the opposite side from the test drawing area 61 (in the present embodiment, the right side in FIGS. 1A and 2A), within a movable range of the drawing head 43 described hereinafter.

A number of pen caps 62 (in the present embodiment, one) exactly corresponding to a pen holder 42, described later, are set in the home area.

The pen cap 62 is formed, for example, from rubber, and at times when the pen 41 is mounted to the drawing device 40 but not drawing (when not drawing), drying out of the pen tip 413 is prevented by lowering the pen 41 and storing the pen tip 413 in the pen cap 62.

An ink jet maintenance area 63 is provided within the home area, at a position corresponding to a position where the ink jet drawing head 71 is disposed when the pen tip 413 is stored in the pen cap 62.

The ink jet maintenance area 63 is configured from, for example, a cleaning mechanism for cleaning an ink discharging area (nozzle surface) of the ink jet drawing head 71, described later, a cap mechanism for maintaining moist conditions of the ink discharging area (nozzle surface), and the like (all not illustrated in the drawings).

Note that the disposal of the pen cap 62, the ink jet maintenance area 63, and the like in the home area is not limited to the examples described herein.

The drawing device 40 is configured from and provided with the drawing head 43, a unit supporting member 44 that supports the drawing head 43, the X-direction movement stage 45 for moving the drawing head 43 in the X direction (the X direction in FIGS. 1A and 2A; the left-right direction of the drawing apparatus 1), an X-direction movement motor 46, the Y-direction movement stage 47 for moving the drawing head 43 in the Y direction (the Y direction in FIGS. 1B and 2A; the front-back direction of the drawing apparatus 1), a Y-direction movement motor 48, and the like.

As illustrated in FIGS. 1A and 2A, in the drawing head 43 of the present embodiment, the pen holder 42 holding the pen 41 and an ink jet holder 72 holding the ink jet drawing head 71 are disposed adjacent to each other.

The ink jet drawing head 71 is, for example, an ink cartridge-integrated head in which ink cartridges (not illustrated in the drawings) corresponding to yellow (Y), magenta (M), and cyan (C) ink are formed integrally with an ink discharging area (not illustrated) provided on a surface (in the present embodiment, the bottom surface in FIG. 1A and the like) facing the drawing object (the nail T) in each of the ink cartridges.

The ink discharging area is provided with a nozzle array consisting of a plurality of nozzles for spraying each color of ink. The ink jet drawing head 71 micronizes the ink and performs the drawing by spraying the ink from the ink discharging area directly on the target drawing surface of the drawing object (the nail T).

Note that the ink jet drawing head 71 is not limited to those that discharge the three colors of ink described above. Ink cartridges holding other colors of ink and ink discharging areas may also be provided.

One pen 41 is mountable in the pen holder 42 of the present embodiment.

The pen 41 is a writing utensil that has the surface of the nail T as its drawing object, and performs a drawing by the tip portion thereof being brought into contact with the drawing object, namely the surface of the nail T.

As illustrated in FIGS. 1A and 1B, the pen 41 is provided with the pen tip 413 on a tip side (the lower side in FIG. 1A and the like) of a rod-like pen shaft portion 411.

An interior of the pen shaft portion 411 is an ink storing portion for storing various types of inks.

Any type of ink can be stored in the interior of the pen shaft portion 411. Viscosity of ink, diameter of the coloring particles (particle size), and the like are not particularly limited and, for example, ink having metallic glitter, white ink, ink for under coats, ink for top coats, nail varnish, and the like can be used.

In the present embodiment, the pen 41 is a ballpoint pen in which the pen tip 413 draws by the ink stored in the pen shaft portion 411 being dispensed by pressing the pen tip 413 against the surface of the nail T.

Note that the pen 41 is not limited to a ballpoint pen. For example, the pen 41 may be a felt-tip pen that draws by soaking ink into a felt-like pen tip, a brush pen that draws by soaking ink into a bundle of hairs, or the like.

The pen 41 having the pen tip 413 of any desired thickness may be provided as well.

The pen 41 set in the pen holder 42 can be replaced with various pens 41. That is, the pen 41 is held by simply being inserted from above into the pen holder 42 and, as such, the pen 41 can be easily replaced by opening the cover 23 provided in the case body 2 and, for example, using hands or tweezers to grab a top end portion of the pen shaft portion 411 and lift the pen 41 out.

The various pens 41 with which the pen 41 is replaced may be pens that all have the same type of the pen tip 413, or may be pens that have different types of the pen tip 413.

Thus, a user can realize a wide range of nail designs by appropriately replacing the pen 41 set in the pen holder 42 for a pen 41 having a different color or a different pen tip 413, or using a different type of ink, depending on the nail design desired to be drawn.

The pen holder 42 holds and fixes one of the pen 41 by a retaining portion (not illustrated), and is a member for moving the pen 41 together with the drawing head 43. In the present embodiment, the pen holder 42 is supported on a side portion of the drawing head 43.

Additionally, the pen holder 42 is configured to be movable in the vertical direction GU, GD by the driving of a pen vertical motor 426 (see FIG. 11) that is mounted on the drawing head 43.

The unit supporting member 44 is fixed to an X-direction movement device 451 that is attached to the X-direction movement stage 45.

The X-direction movement device 451 is configured to move in the X direction along guides (not illustrated) on the X-direction movement stage 45 via the driving of the X-direction movement motor 46.

Thus, the drawing head 43 that is attached to the unit supporting member 44 is configured to be capable of movement in the X direction (the X direction in FIG. 1A and the left-right direction of the nail printing apparatus 1).

The X-direction movement stage 45 is fixed to a Y-direction movement device 471 of the Y-direction movement stage 47.

The Y-direction movement device 471 is configured to move in the Y direction along guides (not illustrated) on the Y-direction movement stage 47 via the driving of the Y-direction movement motor 48.

Thus, the drawing head 43 that is attached to the unit supporting member 44 is configured to be capable of movement in the Y direction (the Y direction in FIG. 1B and the front-back direction of the nail printing apparatus 1).

Note that in the present embodiment, the X-direction movement stage 45 and the Y-direction movement stage 47 are configured from combinations of the X-direction movement motor 46, the Y-direction movement motor 48, and ball screws and guides (not illustrated).

In the present embodiment, a head movement device 49 is configured as an XY drive device that drives the drawing head 43 provided with the pen 41 in the X direction and the Y direction via the X-direction movement motor 46, the Y-direction movement motor 48, and the like.

The pen vertical motor 426, the ink jet drawing head 71, the X-direction movement motor 46, and the Y-direction movement motor 48 of the drawing device 40 are connected to a drawing controller 814 of a control device 80 (see FIG. 11; described hereinafter), and are configured to be controlled by the drawing controller 814.

An imaging device 50 is provided with an image capturing device 51 and an illumination device 52.

The imaging device 50 illuminates the nail T of the print finger U1, which is inserted into the finger insertion area 31 and is visible through the window area 345, using the illumination device 52.

Moreover, the print finger U1 is imaged using the image capturing device 51 and a nail image, namely an image of the nail T of the print finger U1 (image of finger including nail image), is obtained.

In the present embodiment, the image capturing device 51 and the illumination device 52 are fixed on a side (the left side of the drawing head 43 in FIG. 1A) of the drawing head 43 of the drawing device 40.

Specifically, a first edge of the top surface of the drawing head 43 (the left side of the drawing head 43 in FIG. 1A) of the drawing device 40 overhangs in a lateral direction, and a substrate 53 is attached to this overhanging area.

The image capturing device 51 and the illumination device 52 constituting the imaging device 50 are provided on a bottom surface of the substrate 53 so as to face the dividing wall 116.

Note that a size of the substrate 53 and positions where the image capturing device 51 and the illumination device 52 are attached to the substrate 53 are not particularly limited.

The image capturing device 51 is, for example, a small camera having a solid state image sensor with a pixel count of about 2 million pixels or greater, a lens, and the like.

The image capturing device 51 is configured to detect curvature and the like of the nail T of the print finger U1 by movement of the head movement portion 49 so as to image the nail T from at least two different positions or angles.

As a result, at least two nail images are acquired and a nail information detection portion 812 (described hereinafter) detects the nail information such as an outline of the nail T (shape of the nail T), curved shape of the nail T (curvature of the nail T), vertical position of the nail T, and the like on the basis of the nail images.

Note that in the present embodiment, due to the fact that the image capturing device 51 can be moved to above the nail T of the print finger U1, which is inserted in the finger insertion area 31, by the head movement portion 49 and imaging can be performed, it is sufficient that an imageable area of the image capturing device 51 covers the area of one nail T.

The illumination device 52 is, for example, a white LED or similar illuminating lamp.

In the present embodiment, two of the illumination devices 52 are disposed on a front side and a back side of the image capturing device 51 so as to sandwich the image capturing device 51.

The illumination device 52 radiates light downward and illuminates an imaging area below the image capturing device 51.

Note that the disposal and number of the illumination devices 52 provided is not limited to the illustrated examples.

The imaging device 50 is connected to an imaging controller 811 of the control device 80 (described later, see FIG. 11), and is configured to be controlled by the imaging controller 811.

Note that image data of the image imaged by the imaging device 50 is stored in a nail image memory region 821 of a memory device 82 (described later).

The control device 80 is, for example, arranged on a substrate 13 or the like disposed in the upper frame 12.

Figure 11:
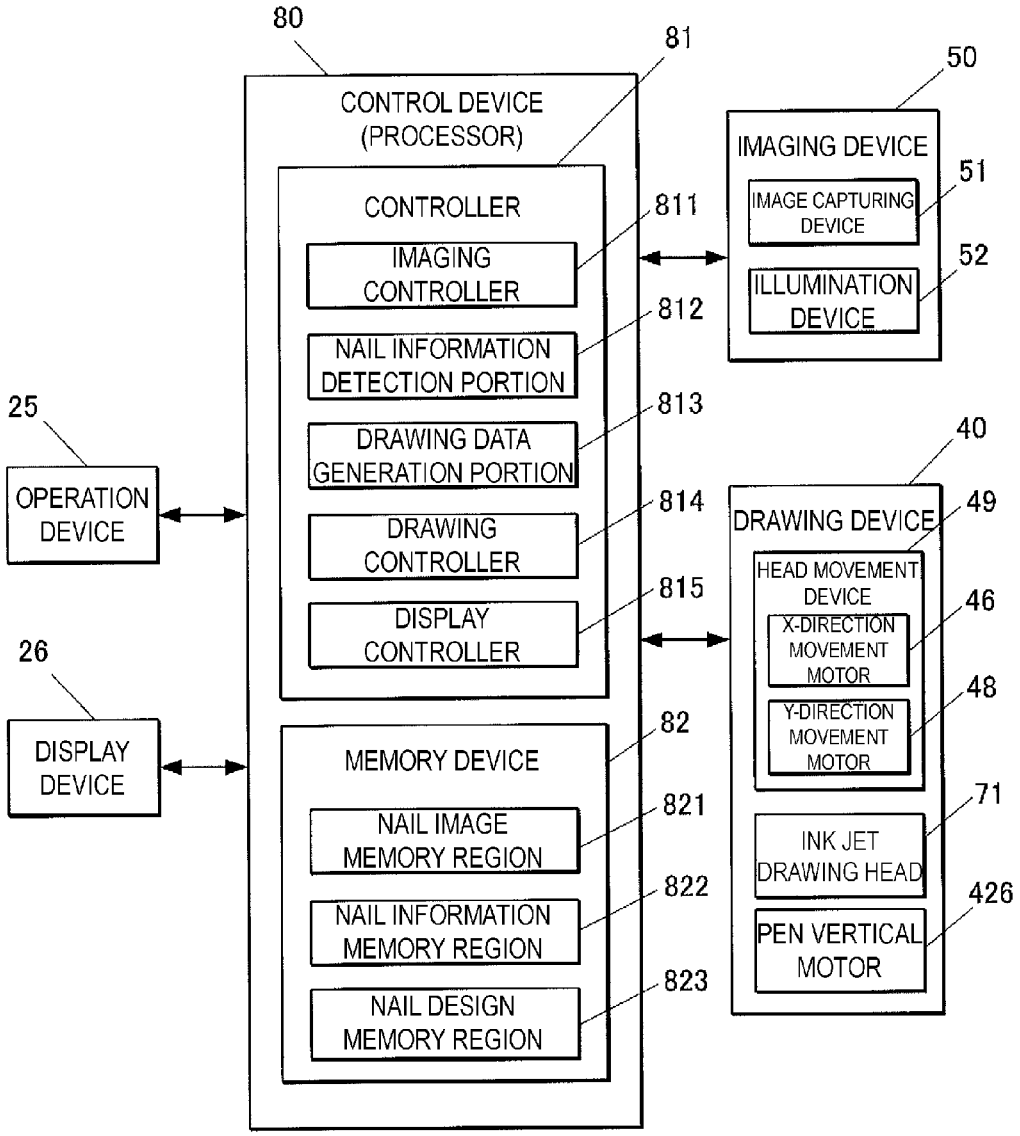
FIG. 11 is a main constituent block diagram illustrating a control configuration of the drawing apparatus according to the embodiment of the present invention.

FIG. 11 is a main constituent block diagram showing the control configuration according to the present embodiment.

As illustrated in FIG. 11, the control device 80 is a computer provided with a controller (processor) 81 constituted by a central processing device (CPU) (not illustrated), and a memory device 82 constituted by read only memory (ROM), random access memory (RAM), or the like (neither illustrated).

Various programs to operate the nail printing apparatus 1, various data, and the like are stored in the memory device 82.

Specifically, various programs are stored in the ROM of the memory device 82 such as a nail information detection program for detecting various types of nail information such as the shape of the nail T, the outline of the nail T, the width of the nail T, the area of the nail T, and the like from the nail images; a drawing data generation program for generating drawing data; a drawing program for performing drawing processing; and the like. A configuration is provided whereby these programs are executed by the control device 80 and, thus, the components of the nail printing apparatus 1 are controlled in an integrated manner.

In the present embodiment, the memory device 82 is provided with the nail image memory region 821 where the nail image of the nail T of the print finger U1 of a user acquired by the imaging device 50 is stored, a nail information memory region 822 where the nail information detected by the nail information detection portion 812 (the outline of the nail T, inclination angle of the nail T, and the like) is stored, a nail design memory region 823 where image data of a nail design to be drawn on the nail T is stored, and the like.

When viewed from a function perspective, the controller 81 is provided with the imaging controller 811, the nail information detection portion 812, a drawing data generation portion 813, a drawing controller 814, a display controller 815, and the like.

Functions of the imaging controller 811, the nail information detection portion 812, the drawing data generation portion 813, the drawing controller 814, the display controller 815, and the like are realized by cooperation of the CPU of the controller 81 and the programs stored in the ROM of the memory device 82.

The imaging controller 811 is configured to cause the image capturing device 51 to capture images of fingers (hereinafter referred to as "nail images"), including images of the nail T of the print finger U1 inserted into the finger insertion space 31, by controlling the image capturing device 51 and the illumination device 52 of the imaging device 50.

In the present embodiment, the image capturing device 51 is moved by the drawing controller 814 that controls the head movement portion 49, and the imaging controller 811 causes at least two of the nail images from two different positions or angles (e.g. directly above the nail T and diagonally above the nail T, or the like), to be acquired.

The image data of the nail image acquired by the imaging device 50 are stored in the nail image memory region 821 of the memory device 82.

The nail information detection portion 812 is configured to detect the nail information of the nail T of the print finger U1 on the basis of the image of the nail T of the print finger U1 inserted into the finger insertion space 31, the image being imaged by the image capturing device 51.

Here "nail information" refers to, for example, the outline of the nail T (nail shape, XY coordinates of the horizontal position of the nail T, and the like), the height of the nail T (position in the vertical direction of the nail T, hereinafter referred to as the "vertical position of the nail T" or simply the "position of the nail T"), the inclination angle with respect to the XY plane of the surface of the nail T (the inclination angle of the nail T or nail curvature), and the like.

The nail information detection portion 812 can accurately detect the curvature and the like of the nail T by performing the detection of the nail information using a plurality of nail images imaged from different positions or angles (e.g. directly above the nail T, diagonally above the nail T, and the like).

The drawing data generation portion 813 generates data for the drawing to be performed by the drawing head 43 on the nail T of the print finger U1, on the basis of the nail information detected by the nail information detection portion 812.

Specifically, on the basis of the shape of the nail T and the like detected by the nail information detection portion 812, the drawing data generation portion 813 performs calibration processing, such as enlarging, reducing, and cropping, for calibrating the image data of the nail design to the shape of the nail T.

The drawing data generation portion 813 performs appropriate curve correction and the like in accordance with the nail information detected by the nail information detection portion 812.

As a result, drawing data for the nail design to be drawn by the pen 41 or the ink jet drawing head 71 is generated.

The drawing controller 814 is a control portion that outputs control signals to the drawing device 40 on the basis of the drawing data generated by the drawing data generation portion 813, and controls the X-direction movement motor 46, the Y-direction movement motor 48, the pen vertical motor 426, the ink jet drawing head 71, and the like of the drawing device 40, so as to perform a drawing on the nail T that corresponds with the drawing data.

Specifically, when the pen 41 is not drawing, the drawing controller 814 controls the pen vertical motor 426 so as to maintain a state in which the retaining protrusion 424 is not pressed down by the plate spring 429; and, when the pen is drawing, the drawing controller 814 causes the pen vertical motor 426 to operate and controls the operation of the pen vertical motor 426 so that the retaining protrusion 424 is pressed down by the plate spring 429 and the tip side (the pen tip 413) of the pen 41 comes into contact with the surface of the nail T.

The display controller 815 is configured to control the display device 26 and cause the display device 26 to display various types of display screens.

In the present embodiment, examples of the various types of display screens the display controller 815 is configured to display on the display device 26 include nail design selection screens and thumbnail images for confirming designs, nail images acquired by imaging the print finger U1, various command screens, operation screens, and the like.

Next, operations of the finger holding apparatus 33 and the nail printing apparatus 1 of the present embodiment including the finger holding apparatus 33 are described.

When assembling the finger holding apparatus 33 of the present embodiment, first, the fixing member 39 is fixed by screws or the like in the lower case 35 at the position where the second engagement protrusion 355 is disposed inside the cylinder of the fixing member 39.

Then, the base end side of the second spring 356 is engaged with the second engagement protrusion 355 and the base end side of the first spring 358 is engaged with the first engagement protrusion 357 (see FIG. 5).

Next, as illustrated in FIG. 6A, the engaging shaft portion 362 is attached in the knock shaft portion 365 of the second pressing member 36 and, as illustrated in FIG. 6B, the rotating member 363 is attached to the lower side of the engaging shaft portion 362 (the lower side in FIG. 4). At this time, the rotating member 363 is locked to the engaging shaft portion 362 by the locking claws 362*b*.

Then, the third pressing member 38 is sandwiched by the joining portion 372 of the first pressing member 37, and this joining portion 372 is joined to the pressing member main body 371.

As a result, the third pressing member 38 is joined to the first pressing member 37 via the third spring 374.

Next, the engaging shaft portions 373 of the first pressing member 37 are inserted into the engagement tube portions 364 of the second pressing member 36, in a state where the third pressing member 38 is joined.

As a result, the first pressing member 37 and the third pressing member 38 joined to the first pressing member 37 are joined to the second pressing member 36 (see FIG. 9).

Then, the pressing mechanism 330 in this joined state is disposed in the lower case 35, in which, as illustrated in FIG. 5, the fixing member 39, the second spring (the second biasing member) 356, and the first spring (the first biasing member) 358 are disposed.

As a result, the second spring 356 is disposed inside the rotating member 363 and is in a biasing state pressing the second pressing member 36 up from below. The first spring 358 is disposed in the recessed portion 371*a* and is in a biasing state pressing the first pressing member 37 up from below.

Thus, the assembly of the finger holding apparatus 33 provided with the pressing mechanism 330 is completed.

Furthermore, the upper case 34 is placed on the lower case 35 in which the pressing mechanism 330 has been set, and is fixed to the dividing wall 116 by screws or the like (see FIG. 2).

As a result, the finger holding apparatus 33 is fixedly disposed at the position of the finger insertion space 31.

In cases where performing drawing by using the nail printing apparatus 1, a user first operates a power switch to turn on the control device 80.

The display controller 815 displays a design selection screen on the display device 26.

Then, the user operates operation buttons or the like on the operation device 25 and selects a desired nail design from among a plurality of nail designs displayed on the design selection screen.

As a result, a selection command signal is output from the operation device 25 and the nail design intended to be drawn on the nail T is selected.

Upon selection of the nail design, the display controller 815 displays a command screen on the display device 26 prompting that the pen 41 required to draw the desired nail design be set in a predetermined pen holder 42 of the drawing head 43.

In accordance with the command displayed on the display screen, the user sets a predetermined type of the pen 41 in the predetermined pen holder 42.

A configuration is possible in which, at this time, the user inputs information (the type of ink stored in the pen 41, or the like) related to the pen 41 set in the pen holder 42 from the operation device 25 or the like.

In cases where the information related to the pen 41 is inputted, the input information is output to the control device 81.

Next, the display controller 815 causes the display device 26 to display a command screen prompting that the print finger U1 be set in the finger insertion space 31.

Then, the user operates a drawing switch (not illustrated) of the operation device 25 after inserting the print finger U1 into the finger insertion space 31, inserting the non-print fingers U2 into the finger resting space 32, and holding the print finger U1 in the finger insertion space 31.

In the present embodiment, in cases where holding the print finger U1 in the finger insertion space 31 provided with the finger holding apparatus 33, first, in an initial set state in which all of the pressing members constituting the pressing mechanism 330 (that is, the second pressing member 36, the first pressing member 37, and the third pressing member 38) are lowered and space for the user to insert the print finger U1 has been secured, the user inserts the print finger U1 in the finger holding apparatus 33 up to the back side along the finger insertion direction F.

At this time, positioning of the nail T is possible by inserting the print finger U1 to the farthest back portion of the first pressing member 37 of the finger holding apparatus 33, and mounting the tip area of the nail T on the first pressing member 37.

After positioning the print finger U1, the user presses the pressing members (in the present embodiment, the second pressing member 36) of the pressing mechanism 330 down once in the downward direction GD using the print finger U1.

As a result, the knock shaft portion 365 will resist the biasing force of the second spring 356 and lower downward while pressing the rotating member 363 down.

In the initial set state, the engaging protrusions 363*c* of the rotating member 363 are engaged with the notched portions 393 of the fixing member 39, and assume a state in which in the upward direction GU movement of the rotating member 363 and the second pressing member 36 joined to the rotating member 363 is restricted. However, due to the knock shaft portion 365 pressing the rotating member 363 down, the engaging protrusions 363*c* of the rotating member 363 are pressed on by the inclined surfaces of the serrated pressing portions 365*a* of the knock shaft portion 365 and move, and are released from the notched portions 393 of the fixing member 39.

Furthermore, when the engaging protrusions 363*c* move to positions corresponding to the guide grooves 392 of the fixing member 39, the locked state of the engaging protrusions 363*c* is released, and the engaging protrusions 363*c* assume a state capable of movement along the guide grooves 392.

At this time, when the user releases the pressing by the print finger U1, the rotating member 363 and the second pressing member 36 joined to the rotating member 363 are pressed up in the upward direction GU by the biasing force of the second spring 356.

When the second pressing member 36 rises, the first pressing member 37 and the third pressing member 38 joined to the second pressing member 36 also rise.

At this time, the guide protrusions 366 of the second pressing member 36 are guided by the guide grooves 359*a* of the lower case 35 and the guide grooves 348*a* of the upper case 34, and the guide protrusions 375 of the first pressing member 37 are guided by the guide grooves 359*b* of the lower case 35 and the guide grooves 348*b* of the upper case 34.

As a result, the pressing members of the pressing mechanism 330 rise in a smooth manner without any positional deviation.

When the top surface of the print finger U1 contacts the finger holding wall 346 (in the present embodiment, the cushioning member 347 provided on the inside surface of the finger holding wall 346), a state is assumed where the pressing members cannot rise any further. At this time, the print finger U1 is sandwiched and secured between the pressing members of the pressing mechanism 330 and the finger holding wall 346 (the cushioning member 347).

Figure 10A:
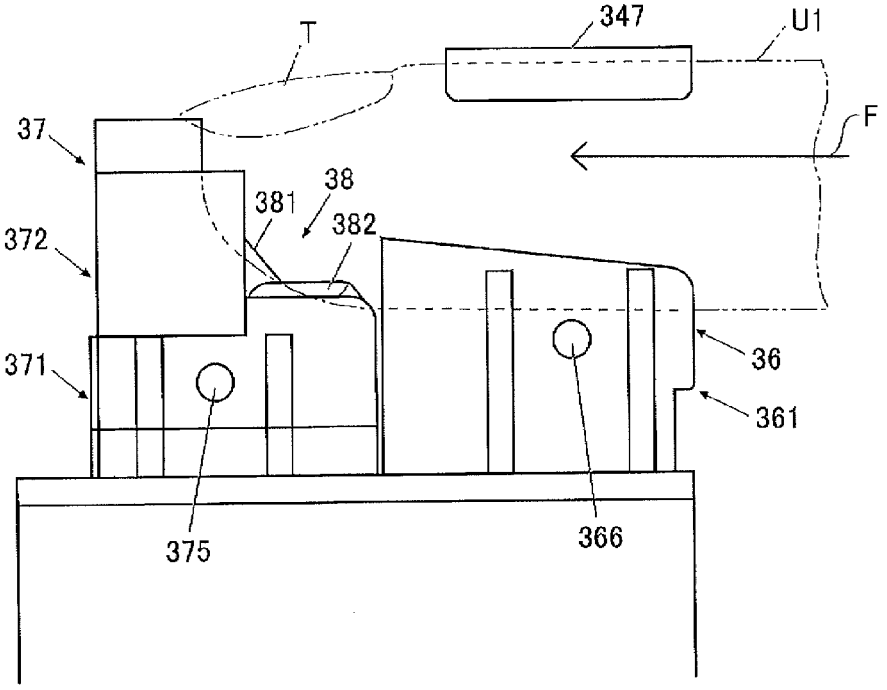
FIG. 10A is a schematic side view of the pressing mechanism in a case where a thick finger is secured.
Figure 10B:
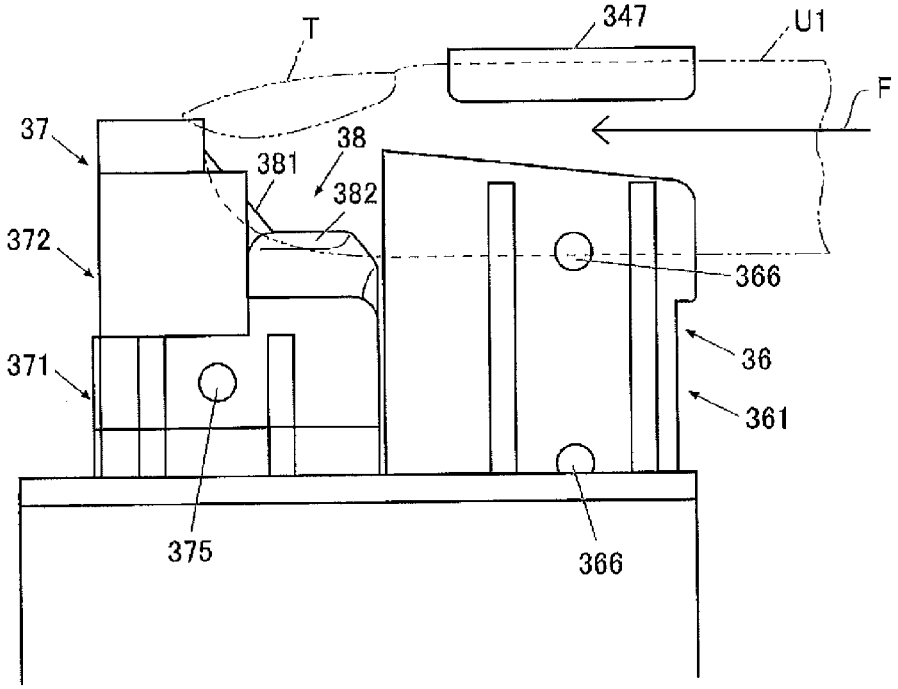
FIG. 10B is a schematic side view of the pressing mechanism in a case where a thin finger is secured.

FIG. 10A illustrates an example of a case where the thickness of the print finger U1 is comparatively thick. FIG. 10B illustrates an example of a case where the thickness of the print finger U1 is comparatively thin.

As illustrated in FIG. 10A, in cases where the thickness of the print finger U1 is comparatively thick, the nail T is disposed at a suitable drawing position (drawable position) in a state in which an amount of press of the pressing members of the pressing mechanism 330 is comparatively small.

In this case, the pressing members (that is, the second pressing member 36, the first pressing member 37, and the third pressing member 38) are each biased by an individual spring (that is, the second spring 356, the first spring 358, and the third spring 374). As such, all portions of the finger including the tip area of the nail, the fingertip, the area around the first joint, and the like are pressed up to suitable heights, and the nail T is, in whole, maintained in a nearly horizontal state without the tip area of the nail being unnaturally overly raised or lowered.

Particularly, the height of the tip area of the nail T can be reliably pressed up to a predetermined position because the first spring 358, positioned farthest back along the finger insertion direction F and biasing the first pressing member 37, is configured as a high load (large biasing force) spring.

As illustrated in FIG. 10B, compared to cases where the thickness of the print finger U1 is thick, the pressing members of the pressing mechanism 330 rise more in cases where the thickness of the print finger U1 is comparatively thin.

In this case as well, the pressing members (that is, the second pressing member 36, the first pressing member 37, and the third pressing member 38) are each biased by an individual spring (that is, the second spring 356, the first spring 358, and the third spring 374). As such, all portions of the finger including the tip area of the nail, the fingertip, the area around the first joint, and the like are pressed up to suitable heights.

Moreover, the height of the tip area of the nail T can also be reliably pressed up to a predetermined position in cases where the print finger U1 is thin and distance to the drawable position is great because the first spring 358, biasing the first pressing member 37, is configured as a high load (large biasing force) spring.

Furthermore, in cases where the thickness of the print finger U1 is particularly thin, a gap is prone to be formed between the fingertip portion or the like and the portion where the finger is mounted. However, in the present embodiment, the fingertip portion can be pressed up from below by the third pressing member 38 and, as such, a gap is less likely to form between the fingertip portion or the like and the portion where the finger is mounted. As a result, the height of the nail T can be maintained without placing a burden on the user.

The portion that the third pressing member 38 contacts will not be unnaturally overly pressed up because the third spring 374 biasing the third pressing member 38 is a low load (small biasing force) spring.

In cases where the drawing processing on the nail T has finished and the print finger U1 is to be pulled out, the user again presses the pressing members (in the present embodiment, the second pressing member 36) of the pressing mechanism 330 down in the downward direction GD using the print finger U1.

As a result, the knock shaft portion 365 will resist the biasing force of the second spring 356 and lower downward while pressing the rotating member 363 down.

At this time, due to the knock shaft portion 365 pressing the rotating member 363 down, the engaging protrusions 363*c* of the rotating member 363 are pressed on by the inclined surfaces of the serrated pressing portions 365*a* of the knock shaft portion 365 and move.

Moreover, when the rotating member 363 is pressed down to a point where contacting the bottom surface of the lower case 35 and the engaging protrusions 363*c* engage with the notched portions 393 of the fixing member 39, the engaging protrusions 363*c* will assume the locked state and the initial set state will be attained.

In this state, a sufficient gap is secured between the top surface of the pressing mechanism 330 and the finger holding wall 346. As such, it is possible for the user to pull the print finger U1 out of the finger insertion space 31.

In the present embodiment, the second pressing member 36 that includes the knock shaft portion 365 is joined to the rotating member 363 by the engaging shaft portion 362. As such, in the locked state in which the engaging protrusions 363*c* of the rotating member 363 are engaged with the notched portions 393 of the fixing member 39, movement in the upward direction GU of the knock shaft portion 365 and the second pressing member 36 that includes the knock shaft portion 365 is restricted.

As a result, lifting up and rattling of the knock shaft portion 365 and the second pressing member 36 that includes the knock shaft portion 365 are suppressed, a gap between the top surface of the pressing mechanism 330 and the finger holding wall 346 can be reliably secured, and insertion and removal of the print finger U1 can be performed in a smooth manner.

As described above, according to the present embodiment, by configuring the pressing mechanism 330 from a plurality of constituents, various types of fingers of different sizes and shapes can be suitably secured using a single pressing mechanism.

Specifically, the finger holding apparatus 33 of the present embodiment is provided with a pressing mechanism 330 that includes a plurality of pressing members (the second pressing member 36, the first pressing member 37, and the third pressing member 38) in the finger insertion space 31 into which the print finger U1 is inserted. The plurality of pressing members are disposed along the finger insertion direction F of the print finger U1 so as to be joined to each other, and each is biased in the upward direction GU by a biasing member (the second spring 356, the first spring 358, and the third spring 374).

By dividing the pressing mechanism that presses the finger up into a plurality of pressing members, print fingers U1 of various shapes can be handled in a flexible manner, and print fingers U1 can be secured in a natural manner.

As such, there is no need to change attachments or the like for each finger and the nail T can be disposed at a suitable drawable position without placing a burden on the user.

Of the plurality of pressing members, the biasing member (that is, the first spring 358) biasing the first pressing member 37, disposed relatively at the back side along the finger insertion direction F, in the upward direction GU has a higher load (greater biasing force) than the biasing members (that is, the second spring 356 and the third spring 374) biasing the other pressing members upward GU.

As such, the tip area of the nail T, which greatly affects the drawing, can be reliably pressed up to a predetermined height and drawing of high quality can be performed.

In the present embodiment, the first spring 358 biasing the first pressing member 37, disposed farthest back along the print finger insertion direction F, in the upward direction GU is configured as a high load (large biasing force) spring; the third spring 374 biasing the third pressing member 38 in the upward direction GU is configured as a low load (small biasing force) spring; and the second spring 356 biasing the second pressing member 36 in the upward direction GU is configured as a medium load (medium biasing force) spring.

As such, the tip area of the nail T can be reliably pressed up and a comparatively natural state of the entire finger can be maintained.

Particularly, due to the fact that the third spring 374 biasing the third pressing member 38, disposed between the second pressing member 36 and the first pressing member 37, is configured as a low load (small biasing force) spring, the gap between the print finger U1 and the pressing mechanism 330 on which the print finger U1 is mounted can be filled without unnaturally overly pressing the print finger U1 up, and the entire print finger U1 can be suitably held.

In the present embodiment, a locking mechanism is provided that is capable of restricting movement of the pressing members.

As such, in cases where inserting or removing the print finger U1 into or from the finger insertion space 31, a gap between the pressing members and the finger holding wall 346 can be reliably secured, and insertion and removal of the print finger U1 can be performed in a smooth manner.

Furthermore, in the present embodiment, the second pressing member 36 includes the knock shaft portion 365 constituting the locking mechanism described above, and further includes the engaging shaft portion 362 as an engaging member that engages this knock shaft portion 365 and the rotating member 363.

As such, when the rotating member 363 is engaged with the fixing member 39, the knock shaft portion 365 and also the second pressing member 36 that includes the knock shaft portion 365 assume a state engaged with the fixing member 39 via the engaging shaft portion 362, and movement in the vertical direction (the vertical direction GU, GD in FIG. 4) is restricted.

As a result, the knock shaft portion 365 and the second pressing member 36 becoming free and rattling after the rotating member 363 is engaged with the fixing member 39 can be prevented.

That is, with a locking mechanism in which a typical lock cam mechanism or the like is used, in a state in which the rotating member has been pressed down and engaged with the fixing member, the knock shaft portion that pressed the rotating member down becomes free and may rattle or lift up when tilting or turning the apparatus upside down. Moreover, if the knock shaft or the second pressing member 36 that includes the knock shaft lifts up, the size (distance in the height direction) of the portion where the print finger U1 is inserted will become smaller and it will be difficult to insert and remove the print finger U1.

Regarding this point, in the present embodiment, the engaging shaft portion 362 is provided, and when the rotating member 363 is engaged with the fixing member 39, the knock shaft portion 365 is engaged with the rotating member 363 via the engaging shaft portion 362. As such, the knock shaft portion 365 and the second pressing member 36 with which the knock shaft portion 365 is engaged do not become free, rattle, or lift up.

As the knock shaft portion 365 and the second pressing member 36 cannot move in the vertical direction GU, GD beyond the range that the engaging shaft portion 362 can move vertically, the knock shaft portion 365 and the second pressing member 36 will not protrude into the finger insertion space 31.

As a result, a gap between the pressing members and the finger holding wall 346 can be reliable secured, space within the finger insertion space 31 can be widened, and insertion and removal of the print finger U1 can be performed in a smooth manner.

The embodiment described above is for the purpose of elucidating the present invention and is not to be construed as limiting the present invention. The invention can of course be altered and improved without departing from the gist thereof.

For example, in the present embodiment, an example of a case was described in which the pressing mechanism 330 of the finger holding apparatus 33 includes the three pressing members 36, 37, and 38. However, the number of pressing members that the pressing mechanism 330 is provided with is not limited, and any configuration in which the pressing mechanism includes a plurality of pressing members may be used.

For example, configurations are possible in which two pressing members are provided or four or more pressing members are provided.

For example, in a case where two pressing members are provided, instead of each being independent, the pressing member 37 and the pressing member 38 of the present embodiment may be integrated and move, or the pressing member 36 and the pressing member 38 of the present embodiment may be integrated and move.

In such a case, the biasing member biasing the pressing member disposed relatively at the back side along the finger insertion direction F in the upward direction GU (the pressing member that determines the height of the nail) is configured to be a higher load (higher biasing force) member than the biasing member biasing the other pressing member upward GU.

The plurality of pressing members may be formed from the same material or the materials used to form each of the plurality of pressing members may be appropriately varied. For example, the first pressing member 37, which is pressed up at the highest load, may be formed from a hard material and the other pressing member may be formed from a comparatively softer material. For example, in cases where the third pressing member 38 or the like, which is disposed at an intermediate portion along the finger insertion direction F, is formed from a comparatively softer material, it can be expected that the load on the print finger U1 will be reduced.

In the present embodiment, an example has been given of a case in which the drawing head 43 is provided with one pen holder 42. However, the number of pen holders 42 provided in the drawing head 43 is not limited to one. For example, a configuration is possible in which two or more pen holders 42 are provided and two or more pens 41 for drawing are held.

In the present embodiment, an example has been given of a case where a user manually replaces the pen 41 held by the pen holder 42 as necessary. However, a configuration is possible in which a waiting space is provided where the pens 41 stand by in a home area, and the required pen 41 is automatically acquired from the waiting space and inserted into the pen holder 42 by a pen replacing mechanism (not illustrated in the drawings).

In the present embodiment, an example has been given of a case where the image capturing device 51 and the illumination device 52 are mounted to the drawing head 43. However, the positions at which the image capturing device 51 and the illumination device 52 are provided are not limited thereto.

For example, the image capturing device 51 and the illumination device 52 may be fixedly disposed to a ceiling portion or the like of the nail printing apparatus 1. In this case, it is preferable that two or more of the image capturing device 51 be provided at offset positions in order to capture two or more nail images from different positions/angles for detecting the shape, curvature, and the like of the nail T as the nail information.

In the embodiment described above, an example has been given of a case in which the curvature and the like of the nail T is detected as the nail information and the drawing data is generated on the basis thereof. However, the detection of the curvature of the nail T is not a necessary constituent of the present invention.

For example, in cases where it is sufficient to find the approximate position of the nail T on which the drawing is to be performed such as a case where one point pattern is drawn at roughly the middle of the nail T, it is not necessary to precisely recognize the shape, curvature, and the like of the nail T, and drawing can be performed without detecting the nail shape and the like.

In the present embodiment, an example has been given of the nail printing apparatus 1 in which fingers are inserted into the apparatus one finger at a time and drawing is performed sequentially. However, a configuration is also possible in which consecutive drawing can be performed on a plurality of fingers, without the need to insert and remove each finger.

In this case, a plurality of the finger holding apparatuses 33 are disposed in the finger insertion space 31.

In the present embodiment, a configuration has been described in which the drawing head 43 of the nail printing apparatus (the drawing apparatus) 1 is provided with the pen holder 42 that holds the pen 41 and the ink jet drawing head 71 for drawing. However, both the pen 41 and the ink jet drawing head 71 being provided is not an essential configuration and a drawing apparatus provided with either the pen 41 or the ink jet drawing head 71 to perform drawing is possible.

The nail printing apparatus 1 described in the present embodiment may be provided with a drying device that includes a heater and a fan.

For example, in cases where the nail printing apparatus 1 performs drawing using an ink that comparatively does not dry quickly, drying time of the ink can be shortened by providing the drying device.

As a result, it is possible to perform quick drawing processing in cases where performing drawings using inks of a plurality of colors.

The embodiment described above is not to be construed as limiting the scope of the present invention and include the scope of the invention recited in the claims and equivalents.

What is claimed is:

1. A holding apparatus, comprising:

an object holding wall; and a plurality of pressing members which is movable in a first direction to the object holding wall, wherein an insertion space is formed by the plurality of pressing members and the object holding wall, and an object that is a finger or a toe having a nail is inserted into the insertion space;

the object holding wall is provided in a position that restricts movement of the object inserted into the insertion space in the first direction;

an end of the object inserted into the insertion space is closer to one of the plurality of pressing members than the other of the plurality of pressing members; and each of the plurality of pressing members applies a biasing force to the object inserted such that the biasing force applied by the one of the plurality of pressing members is greater than biasing forces applied by the other of the plurality of pressing members.

2. The holding apparatus according to claim 1, wherein:

the plurality of pressing members are disposed joined to each other along the insertion direction of the object into the insertion space.

3. The holding apparatus according to claim 1, wherein:

the plurality of pressing members include the first pressing member disposed relatively in the back side in the insertion direction, a second pressing member disposed relatively in a front side in the insertion direction, and a third pressing member disposed between the first pressing member and the second pressing member;

the biasing force applied by the first pressing member has a first value;

the biasing force applied by the second pressing member has a second value;

the biasing force applied by the third pressing member has a third value; and the first value is greater than the second value and the second value is greater than the third value.

4. The holding apparatus according to claim 3, wherein:

the second pressing member is movable in a second direction opposite to the first direction; and the second pressing member includes a locking mechanism configured to set the second pressing member to a locked state in which movement of the second pressing member in the first direction is restricted in a case where pressed an odd number of times in the second direction, and set the second pressing member to an unlocked state in which the locked state is released and the second pressing member is capable of movement in the first direction in a case where pressed an even number of times in the second direction.

5. The holding apparatus according to claim 4, wherein:

the locking mechanism includes:

a knock shaft portion that includes a serrated pressing portion, a rotating member that includes an engaging protrusion, is pressed on by the pressing portion of the knock shaft portion, and rotates, and a fixing member configured to be capable of setting a locked state where engaged with the engaging protrusion of the rotating member and an unlocked state in which the locked state is released.

6. The holding apparatus according to claim 5, wherein:

the knock shaft portion is provided on the second pressing member; and the locking mechanism further includes an engaging member configured to engage the knock shaft portion and the rotating member.

7. The holding apparatus according to claim 3, wherein:

a shape of the second pressing member, along a third direction orthogonal to the insertion direction of the object into the insertion space, comprises a shape whereby movement of the object in a direction crossing the insertion direction can be restricted.

8. The holding apparatus according to claim 1, wherein:

a shape of the first pressing member, along a third direction orthogonal to an insertion direction of the object into the insertion space, comprises a shape that curves convexly toward the first direction and is capable of contacting a tip area of the nail of the object inserted into the insertion space.

9. A drawing apparatus, comprising:

a holding apparatus that holds a object that is a finger or a toe having a nail to be drawn; and a drawing device that performs a drawing on the nail of the object held by the holding apparatus; wherein the holding apparatus comprises:

an object holding wall; and a plurality of pressing members which is movable in a first direction to the object holding wall, wherein an insertion space is formed by the plurality of pressing members and the object holding wall, and the object is inserted into the insertion space;

the object holding wall is provided in a position that restricts movement of the object inserted into the insertion space in the first direction;

an end of the object inserted into the insertion space is closer to one of the plurality of pressing members than the other of the plurality of pressing members; and each of the plurality of pressing members applies a biasing force to the object inserted such that the biasing force applied by the one of the plurality of pressing members is greater than biasing forces applied by the other of the plurality of pressing members.

10. The drawing apparatus according to claim 9, wherein:

the plurality of pressing members are disposed joined to each other along the insertion direction of the object into the insertion space.

11. The drawing apparatus according to claim 9, wherein:

the plurality of pressing members include the first pressing member disposed relatively in the back side in the insertion direction, a second pressing member disposed relatively in a front side in the insertion direction, and a third pressing member disposed between the first pressing member and the second pressing member;

the biasing force applied by the first pressing member has a first value;

the biasing force applied by the second pressing member has a second value;

the biasing force applied by the third pressing member has a third value; and the first value is greater than the second value and the second value is greater than the third value.

12. The drawing apparatus according to claim 11, wherein:

the second pressing member is movable in a second direction opposite to the first direction; and the second pressing member includes a locking mechanism configured to set the second pressing member to a locked state in which movement of the second pressing member in the first direction is restricted in a case where pressed an odd number of times in the second direction, and set the second pressing member to an unlocked state in which the locked state is released and the second pressing member is capable of movement in the first direction in a case where pressed an even number of times in the second direction.

13. The drawing apparatus according to claim 12, wherein:

the locking mechanism includes:

a knock shaft portion that includes a serrated pressing portion, a rotating member that includes an engaging protrusion, is pressed on by the pressing portion of the knock shaft portion, and rotates, and a fixing member configured to be capable of setting a locked state where engaged with the engaging protrusion of the rotating member and an unlocked state in which the locked state is released.

14. The drawing apparatus according to claim 13, wherein:

the knock shaft portion is provided on the second pressing member; and the locking mechanism further includes an engaging member configured to engage the knock shaft portion and the rotating member.

15. The drawing apparatus according to claim 11, wherein:

a shape of the second pressing member, along a third direction orthogonal to the insertion direction of the object into the insertion space, comprises a shape whereby movement of the object in a direction crossing the insertion direction can be restricted.

16. The drawing apparatus according to claim 9, wherein:

a shape of the first pressing member, along a third direction orthogonal to an insertion direction of the object into the insertion space, comprises a shape that curves convexly toward the first direction and is capable of contacting a tip area of the nail of the object inserted into the insertion space.

* * * * *